US010954626B2

(12) United States Patent
Houlbrook et al.

(10) Patent No.: US 10,954,626 B2
(45) Date of Patent: Mar. 23, 2021

(54) APPARATUS, MATERIAL AND METHOD OF APPLYING THE SAME TO GARMENTS IN ORDER TO MAINTAIN A CREASE

(71) Applicant: Supercrease Limited, Leeds (GB)

(72) Inventors: Kenneth Houlbrook, Leeds (GB); Daniel James Houlbrook, Leeds (GB); Katherine Rebecca Stewart, Leeds (GB)

(73) Assignee: Advanced Engineering Solutions, Ltd., Cramlington (GB)

( * ) Notice: Subject to any disclaimer, the term of this patent is extended or adjusted under 35 U.S.C. 154(b) by 44 days.

(21) Appl. No.: 15/738,036

(22) PCT Filed: Jun. 20, 2016

(86) PCT No.: PCT/GB2016/051837

§ 371 (c)(1),
(2) Date: Dec. 19, 2017

(87) PCT Pub. No.: WO2016/203271

PCT Pub. Date: Dec. 22, 2016

(65) Prior Publication Data

US 2018/0282940 A1 Oct. 4, 2018

(30) Foreign Application Priority Data

Jun. 19, 2015 (GB) ..... 1510784

(51) Int. Cl.

| | |
|---|---|
| ***D06M 23/16*** | (2006.01) |
| ***A41D 1/10*** | (2006.01) |
| ***D06B 11/00*** | (2006.01) |

(52) U.S. Cl.
CPC ..... *D06M 23/16* (2013.01); *A41D 1/10* (2013.01); *D06B 11/0073* (2013.01)

(58) Field of Classification Search
None
See application file for complete search history.

(56) References Cited

U.S. PATENT DOCUMENTS 4,778,299 A * 10/1988 Coulter ..... A41D 1/10 118/710

FOREIGN PATENT DOCUMENTS

EP 0225018 A1 6/1987
GB 2158159 A * 11/1985 ..... A41D 1/10

(Continued)

*Primary Examiner* — Michael P. Rodriguez
(74) *Attorney, Agent, or Firm* — Gable Gotwals

(57) ABSTRACT

The invention relates to a method to apply a material which assists in the maintenance of a crease (4) or other formation in a garment (2), such as a crease line in the leg of a pair of trousers. The material (15) which is applied is of a form which minimizes the opportunity for the material (15) to be visible at the time of application and/or during subsequent use of the garment (2). The material (15) is applied using a method and apparatus (100) in which the spacing of the apparatus nib (14) from which the material (15) is applied, from the garment (2) and/or contact of the nib (14) with the garment (2) is controlled by support members (112, 114) such that the material (15) is applied onto the garment (2) and adheres thereto in a manner in which the desired effect of the material (15) is achieved without the material subsequently causing discolouration and/or passing through the garment (2).

11 Claims, 6 Drawing Sheets

(56) References Cited

FOREIGN PATENT DOCUMENTS

| | | | | | |
|---|---|---|---|---|---|
| GB | 2158159 | A | | 11/1985 | |
| KR | 20120132089 | A | | 12/2012 | |
| WO | WO-0074865 | A1 | * | 12/2000 | ..... A41D 1/10 |
| WO | WO 0074865 | A1 | | 12/2000 | |

* cited by examiner

APPARATUS, MATERIAL AND METHOD OF APPLYING THE SAME TO GARMENTS IN ORDER TO MAINTAIN A CREASE

CROSS-REFERENCE TO RELATED APPLICATIONS

This application is the United States National Phase of Patent Application No. PCT/GB2016/051,837 filed 20 Jun. 2016, which claims priority to British Patent Application No. 1510784.0 filed 19 Jun. 2015, each of which are incorporated herein by reference.

BACKGROUND OF THE INVENTION

The invention relates to the application of a liquid material solution to garments and in particular applying the material along a crease line formed in the garment. The purpose of applying liquid material along the crease line is to allow the ribbon of the material which is applied to retain the form of the crease in the garment, such as in a pair of trousers. Once the material has cured the crease in the garment will be retained for a longer period of time than would normally be the case.

The use of certain types of material to increase the duration of the existence of a crease in a garment is well known. The material is typically applied to the interior side of the garment by the garment manufacturer prior to the garment being made available for purchase and/or can be applied by garment handling operators after the garment has been purchased, such as, for example by a dry cleaning provider with the application of the material being provided as an optional extra service. In either case it is known that the application of the ribbon or elongate line of the liquid material along the crease does increase the longevity of the crease in the garment and therefore provides the garment with a relatively smart appearance for a longer period of time.

The liquid material is typically provided in a cartridge with a piston therein which causes the required quantity of the material to exit through a cartridge opening as the cartridge is moved along the crease in the garment and hence the liquid material is applied as required along the crease.

A problem which has been experienced is that once the conventional liquid material has been applied, and typically at, a period of time after application, a colouration of the previously transparent material occurs, or a discolouration of previously coloured material can occur. Typically the colouration is a substantially white colouration which is visible on the opposing side from which the material has been applied, i.e. visible on the external surface of the garment. This white line effect shows up or is increased after wear, dry cleaning and/or washing of the garment.

Figure 1:
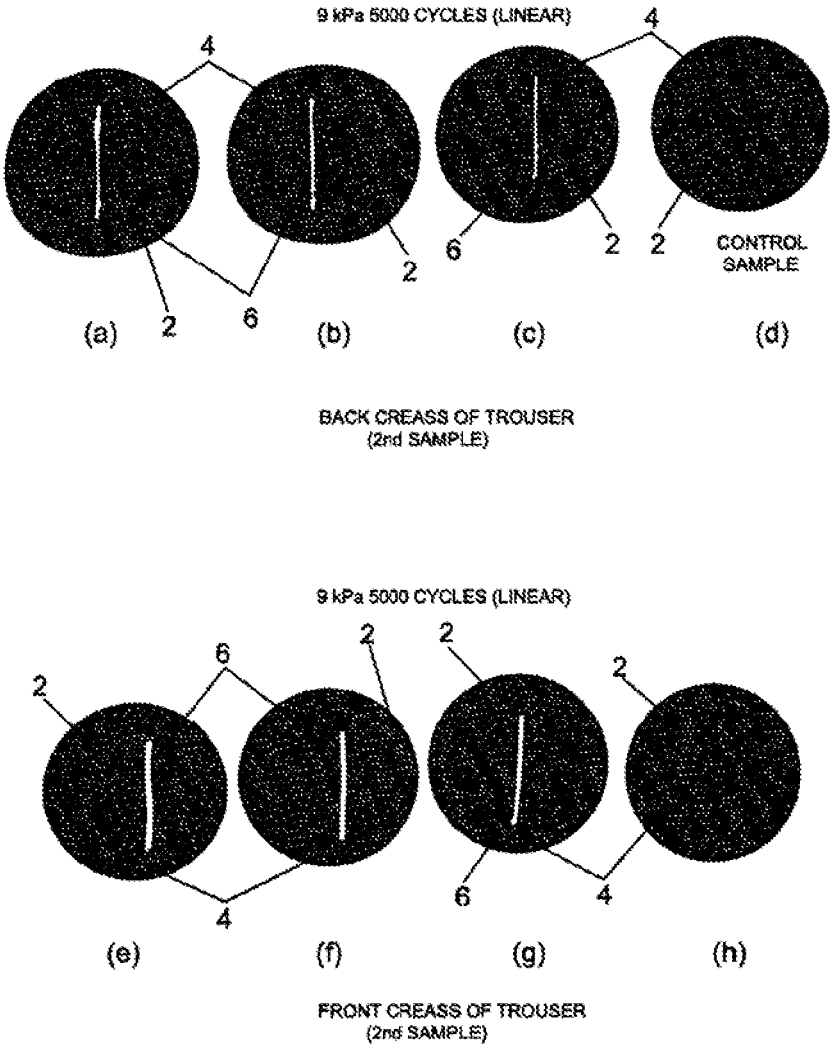

Conventionally it has been believed that the white line effect was caused by a silicon filler material provided as part of the liquid material and the fact that the liquid material shows through the holes between the weave on an open weave/plain weave fabric garment, or, on a more lightweight fabric garment, the liquid material permeates the ultra fine yarns and wets out the yarn on the visible surface on the outside of the crease line so that when it becomes relatively worn, is dry cleaned and/or washed the liquid material is exposed and shows as a white line. This effect is most apparent on darker fabrics with the white line being viewable externally of the garment and hence visible through the garment, and from the opposing side of the garment to that on which the material was applied. Examples of this are provided in FIGS. 1*a-f* to which the conventional liquid material has been applied along a crease line. Control samples are shown in FIGS. 1*g-h* and to which none of the conventional liquid material has been applied. The crease line has been subjected to 5000 cycles of linear rubbing along the crease with FIGS. 1*a-c*, illustrating the back crease of a trouser garment and the FIGS. 1*d-f* illustrating the front crease of the trouser garment.

This problem of the visible white line has been a problem for many years and the problem has increased and/or become more apparent as the use of lighter and super lightweight fabrics has become increasingly prevalent for suits and trousers in warmer climate countries. This problem has limited the range and type of garment to which the conventional liquid material can be applied to retain the crease and, as a result, the clear advantages of the retention of the crease in the garment cannot be obtained. For example, in warmer climates where the use of lighter clothing is more prevalent the use of the apparatus and method is less popular due to the visible white line effect.

The conventional liquid material which has been used is typically a silicon based material and includes a filler which can be referred to as fume silica or fumed silica, hereinafter referred to as fumed silica. The filler is added as a bulking agent and/or to aid the flowability and/or affects the viscosity of the products. Attempts to reduce the white line effect have been made over a number of years, including the addition of quantities of carbon black to try and colour the liquid material and reduce the white line effect, but no significant advantage has been obtained.

The aim of the present invention is to provide apparatus, a method and/or a liquid material which can be used to reduce or avoid the occurrence of an adverse visual effect, such as a white line effect, caused by the line of liquid material which has been applied to the garment.

In a first aspect of the invention there is provided a method of applying a liquid material substance to a garment to aid retention of a crease formed in the garment, said method including the steps of applying a ribbon or elongate line of the liquid material along or adjacent to the crease line from a material dispenser, during relative movement between the dispenser and garment, said liquid material subsequently cured to substantially retain the crease form and wherein the dispenser for the liquid material includes a nib from which the liquid material is emitted with the rub held with respect to the crease line so as be out of contact or in substantially non pressure contact with the garment so as to prevent the pressure of application of the material causing the same to be forced through the garment.

Typically if the nib is not in contact with the garment the material is emitted so as to bridge the gap between the nib and the garment and attach to the garment.

In one embodiment the material is held in a dispensing cartridge which includes the nib with an aperture through which the material can be dispensed onto or adjacent to the garment crease. Typically the garment is held in a fixed position and the cartridge is moved along the length of the crease line with the material being dispensed therefrom in a controlled manner. In one embodiment the cartridge is provided with guides which pass along or in line with the crease and guide the movement of the cartridge when the cartridge is being moved along the garment.

Typically the nib is placed into position on the dispensing aperture and can be provided at an angle offset and spaced from the garment. Typically the relationship between the end of the nib and the base of the guide members is important in controlling the position of the nib, and hence application, of the material at the required depth into the garment. In one embodiment, the relationship can be altered to suit the particular material which is being applied and/or the weight of the fabric from which the garment has been made. For example, a selection of the distance of the nib end from the garment can be made to prevent the material from completely passing through the fabric whilst ensuring that the retention of the crease is maintained. This is found to reduce the creation of the white line discolouration. The control of the wetting out of the material and/or the type of material applied with regard to the type of fabric may also be used to advantage.

In one embodiment the spacing of the nib from the garment crease to which the material is applied extends from no pressure contact such that the nib "kisses" the garment to a spacing up to 0.07 mm.

In one embodiment the nib of the cartridge is provided at the first end of the cartridge and, at the opposing end, there is provided means to allow connection to a pressurised fluid source such as compressed air which acts on a piston located in the cartridge.

Typically the pressurised air is introduced into the cartridge in a controlled manner, typically by manual control, and at a selected pressure so as to move a piston located in the cartridge along the interior of the cartridge and, as it does so, moves the material within the cartridge towards and out of the dispensing aperture in a controlled manner.

In a preferred embodiment the cartridge is provided with a non return member so as to prevent the piston from returning to its starting position and hence prevent refilling of the cartridge.

Typically the viscosity of the material is selected such that the material will contact with and adhere to the garment whilst not penetrating through the garment fabric to thereby avoid the creation of the discolouration or "strike through".

In one embodiment the material is introduced into the crease to a sufficient extent such that it effectively locks the fibres and/or yarns of the fabric of the garment or garment piece at and/or adjacent to the crease in the position at which the same are located when the material is applied.

In one embodiment the material is applied to the inside of a preformed crease in a garment to a sufficient extent to permeate into the weave and, once cured, retain the structure of the weave to act to retain the preformed crease in that position. Thus the folded pressed crease line yarns cannot move in relation to each other and hence the crease is retained for a longer period of time than it would if the material was not applied.

In a further aspect of the invention there is provided a material for use to be applied to a garment crease when the material is in a liquid state in order to retain the crease for a period of time and wherein said material is a polyurethane hybrid compound.

In one embodiment the material cures on exposure to atmospheric humidity and forms an elastomer along the line of application of the material on the garment.

In one embodiment the material is formed as a non-sag elastic 1-c sealant material.

Preferably the material is a compound with high abrasion resistance and in one embodiment is silicone and PVC free.

Typically the material can be coloured or provided in a substantially transparent form.

It is found that the liquid material in accordance with the invention retains the crease form and eliminates or reduces the creation of the white line visual effect during subsequent use of the garment.

In a further aspect of the present invention there is provided apparatus for applying a material along a crease line in a garment, said apparatus including a cartridge with a cavity in which a quantity of the material is retained, said cartridge having a nib with a dispensing aperture through which the material can be selectively dispensed and wherein the nib is maintained in substantially non pressure contact with, or at a spaced distance from, the garment to which the material is to be applied, by one or more support members provided on the cartridge and which contact with the garment to maintain the nib at the required location with regard to the garment.

In one embodiment the nib is manufactured from a material of a type such that if the same contacts with the garment material, the material dispensed from the nib is not forced by the nib through the garment.

In one embodiment the nib is formed from a material which is capable of deformation when force is applied to the cartridge to move the nib into contact with the garment so as to reduce the force applied by the nib to the dispensed material and hence resist the dispensed material from being forced from one side of the garment to which the material is applied, to the opposing face.

In one embodiment the cartridge includes a piston head movable along said cartridge cavity under the influence of a pressurised fluid introduced into the cartridge cavity via a connection provided on the cartridge to a pressurised fluid source.

In one embodiment the contact face of the nib is provided to be located at an angle in the range of 2 to 10 degrees with respect to the garment surface. Preferably the angle is substantially 5 degrees so as to allow the liquid material to flow through the aperture in the nib onto the garment.

In one embodiment the material is moved through the cartridge towards the nib at a pressure substantially in the region of 15 psi.

In one embodiment said garment to which the material is to be applied is positioned on a support surface with the crease in the garment or garment piece along which the material is to be applied located to lie along an elongate valley formation in the support surface.

In one embodiment the valley formation is substantially V or U shaped.

In one embodiment at least two spaced support members are located in line with the nib and are moved along the crease line in advance of the nib with regard to the direction of movement of the cartridge.

In one embodiment the support members are provided in the form of wheels.

In one embodiment the wheels are provided as part of a carriage on which the cartridge is located and the cartridge and carriage move with respect to the garment as the material is applied.

In one embodiment the wheels are located on or with the cartridge and in line with the nib and contact with the garment so as to be moved along the crease line.

In one embodiment the garment is placed on a surface of a stand, said surface including an elongate groove and the crease line of the garment to which the material is to be applied is positioned to lie in and along the said groove and along which the nib of the cartridge is then moved to apply the material along the crease line.

In one embodiment the groove is U or V-shaped in cross section and the garment crease line is V shaped in cross section and the garment is positioned with respect to the groove such that the base point of the V lies in the base of the U or V shaped groove and the material is applied into the V of the garment crease line.

Figure 2A:
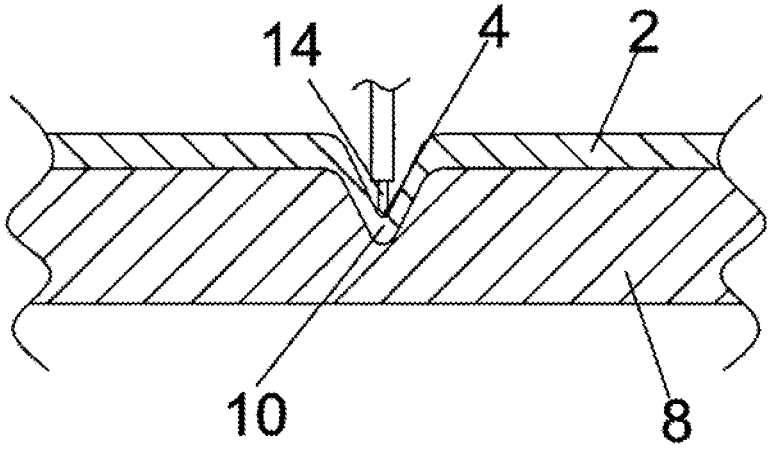
Figure 2B:
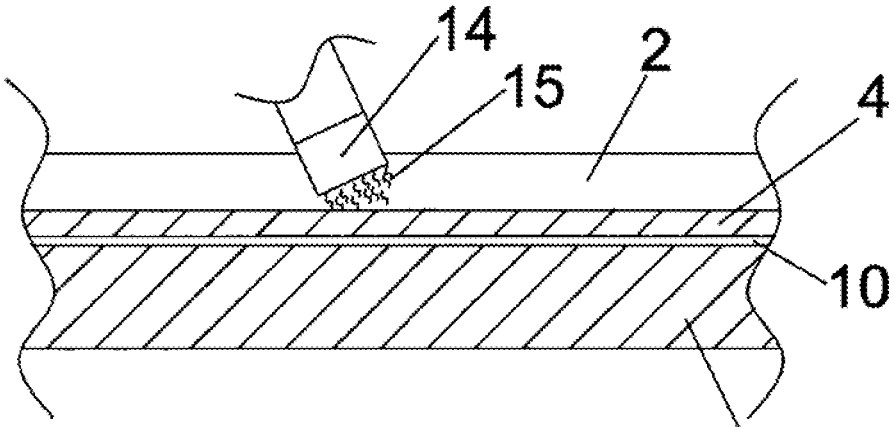
Figure 3A:
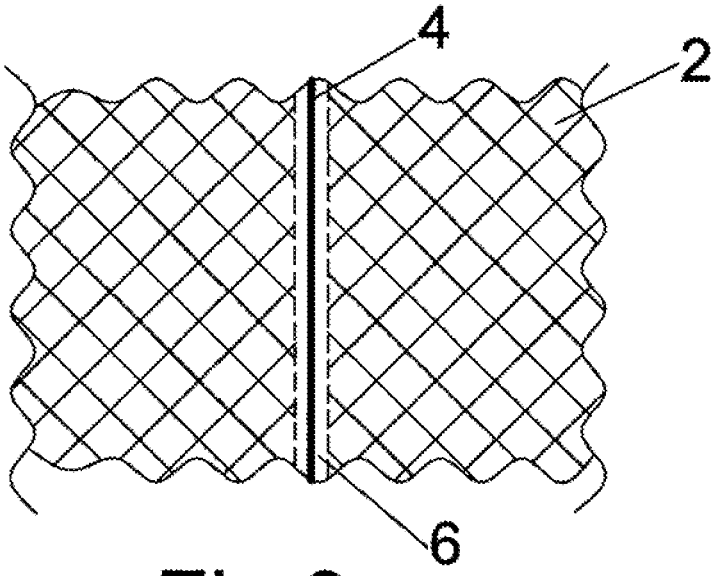
Figure 3B:
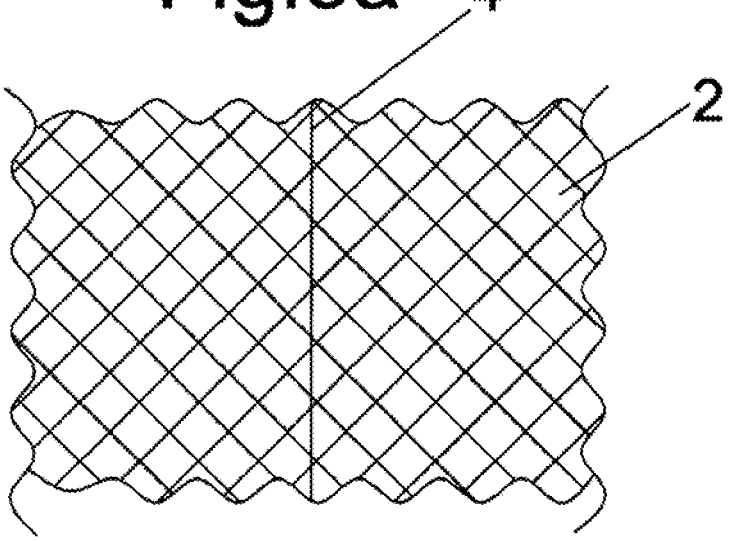

Specific embodiments of the invention are now described with reference to the accompanying drawings wherein;

FIGS. 1*a* through 1*h* illustrate test results using a conventional material of the prior art;

FIGS. 2*a* and *b* illustrate in schematic manner a cross sectional end elevation and cross sectional elevation of the support surface and the apparatus for application of the material in accordance with the invention;

FIG. 3*a* illustrates a garment with a crease with conventional material applied and FIG. 3*b* illustrates a garment with a crease with material applied in accordance with the invention;

FIGS. 4*a-d* illustrate a cartridge with a nib in accordance with one embodiment of the invention; and FIGS. 5*a-f* and 6*a-f* illustrate test results obtained using the material in accordance with the invention in one embodiment.

Figure 4:
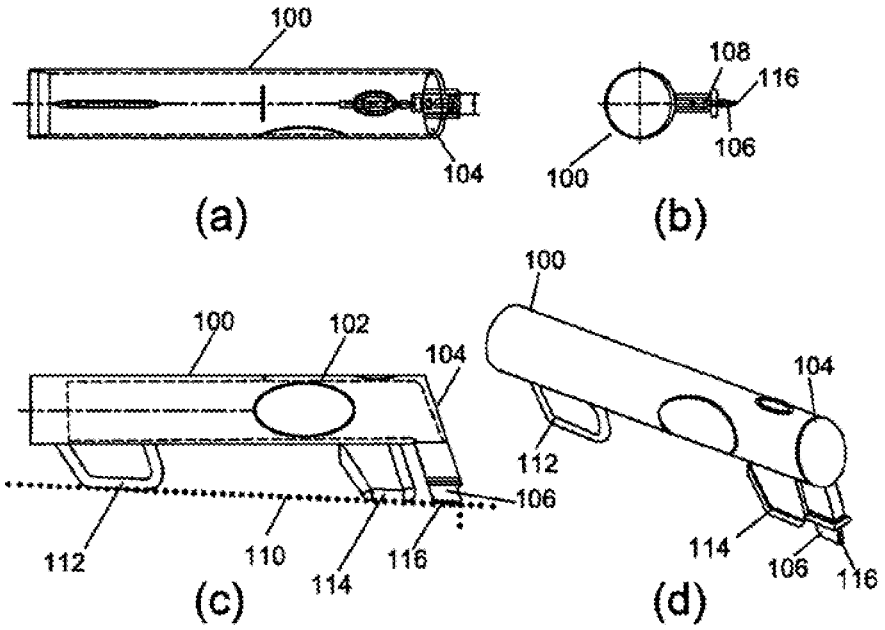

Referring firstly to FIGS. 4*a-d* there is illustrated a cartridge 100 which includes a body portion in which is provided a cavity 102 (shown in broken lines in FIG. 4*c*). The cavity contains a quantity of material which is moved for dispensation via a piston towards the dispensing end 104. The dispensing end has a nib 106 in fluid communication with the cavity so that material can flow through a channel 108 provided in the nib and which leads to an opening at the free end 116 of the nib so that material can flow out of the nib and onto the garment crease 110, also referred to as the strike line.

The cartridge also includes first and second support members 112,114 which contact with the garment crease line (also referred to as the strike line) as shown. In accordance with the invention, the arrangement of the size or depth of the support members 112, 114 define the distance of the cartridge body 102 from the garment and, more importantly, they, in conjunction with the length of the nib 106 which is fitted to the cartridge, allow the position of the free end 116 of the nib with respect to the garment to be set and maintained as the cartridge is moved along the garment to apply the rein thereto, in accordance with the invention, the free end of the nib is positioned such that there is a non-pressure, contact between the nib and the garment or, a gap is maintained between the free end of the nib and the garment so that there is no contact between the same. This ensures that the material reaches and attaches to the fabric of the garment crease line in a manner so that the material is effectively laid onto the aliment crease line rather than being pressed into and through the fabric of the garment.

As an alternative to the use of support member "skids" as shown, the support members may be provided as wheels mounted on the cartridge or on a carriage to which the cartridge is attached and the wheels are again aligned with the nib to allow the material to be applied therefrom along the crease line. In one embodiment this means that the wheels are rolled along the crease line.

The cartridge can be provided in one embodiment with a non return member within the cavity which allows the movement of the material towards the dispensing aperture and prevents refilling of the cartridge respectively. The piston is moved by the pressurised air which is introduced to the rear of the same. The supply of the fluid and movement of the cartridge with respect to the garment can be controlled by the operator of the apparatus.

FIGS. 2*a* and *b* illustrate one embodiment of apparatus for use in applying the material of this application. The apparatus comprises a stand with a support surface 8 in which a V shaped channel 10 is provided. The garment 2 is located with respect to the channel 10 such that the crease line 4 formed therein lies long the channel. The cartridge nib 14 is provided in the cartridge that is located to be moved along the channel and through which material 15 is dispensed along the crease line 4 as the cartridge is moved along the garment crease line with the support member guides or fins on the underside of the cartridge contacting with the garment in the crease and the support surface in the channel 10 and hence guiding the movement and also supporting the end of the nib at the required distance and angular orientation from the garment so as to control the depth of absorption of the material into the garment.

Referring now to FIG. 3*a* there is illustrated part of a garment 2 with a crease line 4 formed therein. The retention of the crease line 4 in FIG. 3*a* and FIGS. 1*a-f* has been achieved in a conventional manner and using a conventional material which typically will include 15% fumed silica with the remainder of the contents being silicone or modified silicone based components. The material is typically applied to the inner face of the garment with the nib of the cartridge in contact with and pressing into the garment to force the material applied therefrom into and through the fabric of the garment. In FIG. 3*a* the external face of the garments is shown and it is found that after wear, ironing and/or washing or dry cleaning that a white line 6 becomes viewable externally of the garment with the white being created along the area where the material has been applied as shown in FIG. 3*a* and FIGS. 1*a-f*. This is a particular problem with lighter fabrics and/or more open weave fabrics where the material colour can be more easily viewed through the fabric and hence be exposed on the external surface thereof.

The same type of garment is illustrated in FIG. 3*b* and in this case the material is in accordance with the present invention and which has been applied along the crease line using a nib with it's free end spaced from the garment as described with reference to FIGS. 4*a-d*. It will be seen that in this case no white line is present or viewable along the crease 4. The applicant has therefore found that the use of the material in accordance with the present invention and particularly when applied using this non pressure contact or gap between the nib and garment and with the nib outlet at an angle of 5 degrees with respect to the garment means that the visible white line does not occur on the crease and so the appearance of the garment is unaffected. This also extends the potential scope of use of the application apparatus and method by which the material can be applied to garments where this previously may not have been possible and also for use in countries where lighter weight clothing is predominantly worn especially when the material used is that provided in accordance with this invention. This is illustrated with reference to the test results shown in FIGS. 5*a-f* and 6*a-f*.

Figure 5:
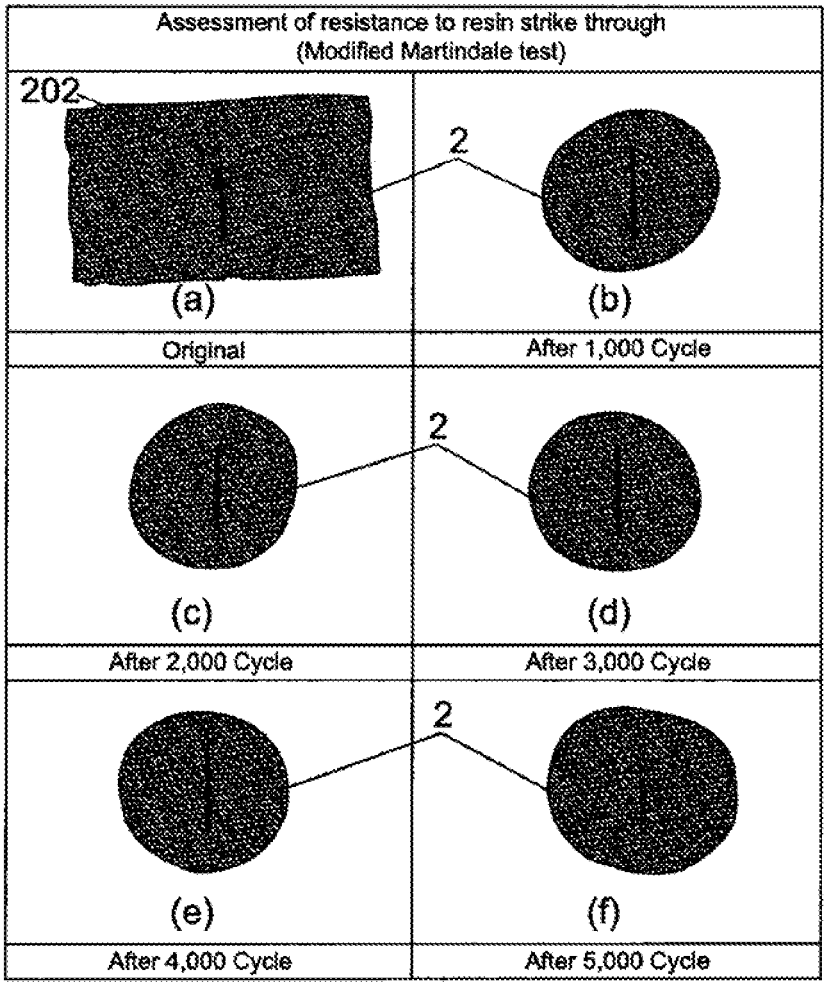
Figure 6:
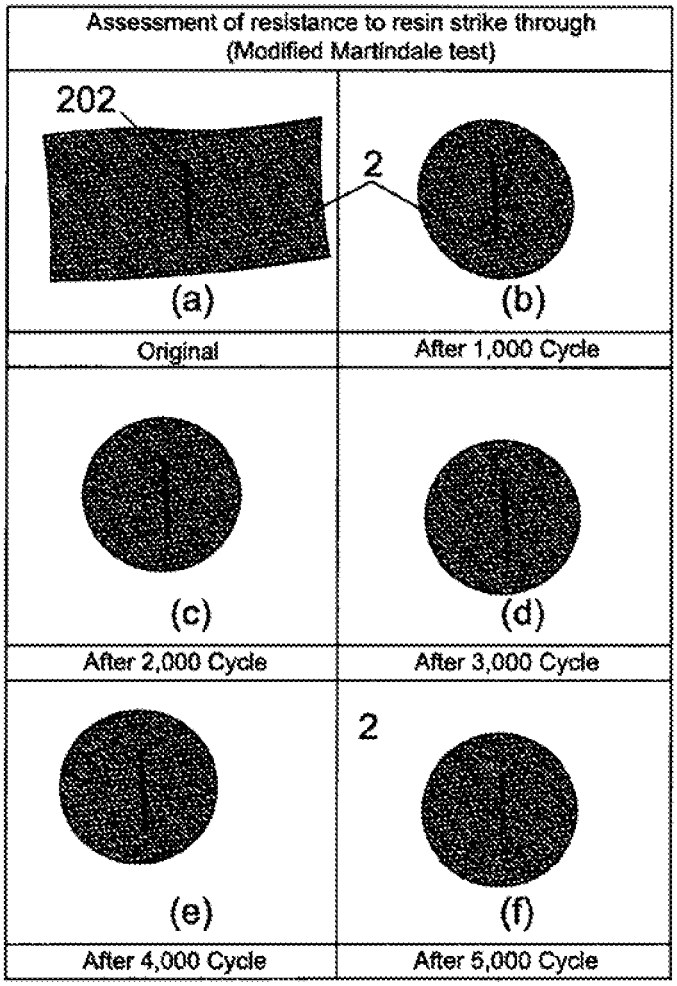

FIGS. 5*a-f* and 6*a-f* illustrate test results obtained using a material in accordance with one embodiment of the invention and in each case there is illustrated the garment with the original crease line 202 in FIGS. 5*a* and 6*a* and then the crease line condition thereafter after 1000 rub cycles (FIGS. 5*b* and 6*b*); 2000 cycles (FIGS. 5*c* and 6*c;* 3000 cycles (FIGS. 5*d* and 6*d*); 4000 cycles (FIGS. 5*e* and 6*e*) and 5000 cycles (FIGS. 5*f* and 6*f*). It will be seen that in each case there is no white line effect after the rubs which is in contrast to the results obtained using the conventional material illustrated in FIGS. 1*a-f*. The material is required to have sufficient viscosity to allow the same to be laid onto the surface of the garment to provide the desired effect without soaking through the fabric of the garment while at the same time being able to leave the aperture in the nib, creating flow across any gap between the nib and the fabric to make contact with, and remain in contact with, the said fabric. The spacing of the nib from the garment means that the material leaves the nib and pressure and/or gravity cause the material to be applied onto the garment and adhere thereto in a manner in which the effect of the material on the crease is achieved without the material subsequently causing discolouration.

The invention claimed is:

1. Apparatus for applying a material along a crease line in a garment, said apparatus comprising:

a cartridge with a cavity in which a quantity of the material is retained; and said cartridge having a dispensing aperture through which the material can be selectively dispensed from said cavity and one or more support members are provided on the cartridge and which contact with the garment, wherein at least one nib is provided to be selectively located on the dispensing aperture to allow the material to pass from the dispensing aperture and through the selectively located nib onto the garment wherein the nib is selectively located and adjustably positioned on the dispensing aperture with reference to the one or more support members so that the nib end is selectively positioned in a substantially non-pressure contact location with respect to the garment or at a spaced distance from the garment when the one or more support members are located on the crease line to maintain the nib end at a selected position with regard to the garment, the selected position of the nib end determined with respect to a weight of the fabric from which the garment is made and/or the particular material which is being dispensed onto the garment.

2. Apparatus according to claim 1 wherein the nib is manufactured from a material of a type such that if the nib contacts with the garment material, the material dispensed from the nib is not forced by the nib through the garment.

3. Apparatus according to claim 2 wherein the nib is formed of a material which is capable of deformation when force is applied to the cartridge to move the nib into contact with the garment so as to reduce the force applied by the nib to the dispensed material and hence resist the dispensed material from being forced from one face of the garment through to the opposing face of the garment.

4. Apparatus according to claim 3 wherein the cartridge includes a piston head movable along said cavity under influence of a pressurised fluid introduced into the cartridge cavity via a connection provided on the cartridge to a pressurised fluid source.

5. Apparatus according to claim 4 wherein a contact face of the nib is provided to be located at an angle in a range of 2 to 10 degrees with respect to a garment surface.

6. Apparatus according to claim 1 wherein at least two spaced support members are located in line with the nib and are moved along the crease line in advance of the nib with regard to a direction of movement of the cartridge.

7. Apparatus according to claim 1 wherein at least two spaced support members are provided in a form of wheels.

8. Apparatus according to claim 7 wherein the wheels are provided as part of a carriage on which the cartridge is located and the cartridge and carriage move with respect to the garment as the material is applied.

9. Apparatus according to claim 7 wherein the wheels are located on or with the cartridge and in line with the nib and contact with the garment so as to be moved along the crease line.

10. Apparatus according to claim 1 wherein the garment is placed on a surface of a stand, said surface including an elongate groove and the crease line of the garment to which the material is to be applied is positioned to lie in and along the said groove and along which the nib of the cartridge is then moved to apply the material along the crease line.

11. Apparatus according to claim 10 wherein the elongate groove is U or V-shaped in cross section and the garment crease line is V shaped in cross section and the garment is positioned with respect to the elongate groove such that a base point of the V lies in a base of the U or V shaped groove and the material is applied into the V of the garment crease line.

* * * * *